United States Patent [19]

Sadow

[11] Patent Number: 4,846,319

[45] Date of Patent: Jul. 11, 1989

[54] EXPANDABLE CARRYING CASE

[75] Inventor: Bernard D. Sadow, Chappaqua, N.Y.

[73] Assignee: United States Luggage Company, New York, N.Y.

[21] Appl. No.: 137,236

[22] Filed: Dec. 23, 1987

[51] Int. Cl.[4] ..... A45C 7/00

[52] U.S. Cl. ..... 190/105

[58] Field of Search ..... 190/103, 104, 105, 22, 190/15 R

[56] References Cited

U.S. PATENT DOCUMENTS

| | | | |
|---|---|---|---|
| 764,144 | 7/1904 | McGowan | 190/105 |
| 1,052,018 | 2/1913 | Spitz | 190/104 |
| 2,475,961 | 7/1949 | Hilbert | 190/105 |
| 3,321,053 | 5/1967 | Doppelt | 190/104 |
| 3,523,596 | 8/1970 | Dyke | 190/103 |
| 4,356,899 | 11/1982 | Tawil | 190/103 |
| 4,366,886 | 1/1983 | Tawil | 190/103 |

FOREIGN PATENT DOCUMENTS

| | | | |
|---|---|---|---|
| 2026 | 5/1926 | Australia | 190/103 |
| 171309 | 5/1952 | Austria | 190/104 |
| 2632589 | 1/1978 | Fed. Rep. of Germany | 190/103 |
| 11502 | 5/1911 | United Kingdom | 190/22 |
| 330031 | 6/1930 | United Kingdom | 190/103 |

*Primary Examiner*—William Price

*Attorney, Agent, or Firm*—Abelman Frayne Rezac & Schwab

[57] ABSTRACT

A carrying case includes telescoping walls that can be attached one to the other in alternative positions of adjustment to permit expansion or reduction of the interior volume of the case.

1 Claim, 3 Drawing Sheets

EXPANDABLE CARRYING CASE

FIELD OF THE INVENTION

This invention relates to a carrying case of the type having a hard perpipheral frame, such as a brief case or a suit case.

BACKGROUND OF THE INVENTION

Brief cases and suitcases both are well known in the art which incorporate a main body of the case having a rigid peripheral wall, to which a lid having a rigid peripheral wall is hinged. A handle is provided for carrying the case, and, suitable locks are provided interconnecting the main body of the case and the lid.

In a brief case in particular, the top and bottom walls of the case commonly are rigid and are attached respectively directly to the associated rigid frame of the main body and the lid. In a suitcase, the top and bottom walls of the case can either be rigid, or, optionally they can be formed from panels of a flexible fabric material which are respectively attached at their peripheral edges to the associated rigid frame of the case body and the lid.

More particularly in a brief case construction, it is known to attach the bottom wall of the case body by means of an accordian pleated peripheral skirt attached to the rigid peripheral frame at one of its edges, and to the associated bottom wall at the opposite one of its edges, the peripheral skirt being flexible and permitting the interior volume of the brief case to be expanded by releasing members holding the bottom wall in a normal position in which it is closely adjacent the rigid peripheral frame, and by then extending the accordian pleated skirt. However, accordian pleated skirts are unsightly in appearance, both in the normal position of the bottom wall and its extended position, and also are readily subject to perforation, tearing or ripping in the event that the case is handled roughly.

SUMMARY OF THE INVENTION

It is an object of this invention to eliminate the unsightly appearance of such accordian pleated skirts and the inherant structural weakness of such skirts, while at the same time providing a carrying case in the form of a brief case of a suitcase or the like that can be expanded in internal volume.

According to the present invention, at least the bottom wall of the case is provided with a rigid peripheral frame that is telescopingly received within the rigid peripheral frame of the main body of the case, and which is movable relative to the rigid peripheral frame of the main body of the case to increase or decrease the internal volume thereof, securing means being provided for holding the rigid peripheral frame of the bottom wall in a desired adjusted position relative to the rigid peripheral wall of the main body of the case.

In an identical manner, the top wall of the case optionally can be provided with a rigid peripheral frame that is telescopingly received within the rigid peripheral frame of the lid, and which is movable relative thereto, securing means being provided for holding the rigid frame of the top wall in a selected position of adjustment.

Thus, a carrying case construction is provided in which the interior volume of the case can be expanded or reduced in dependence on the carrying needs of the case, this being in the absence of accordian pleats, and, in a manner which results in an extremely attractive appearance of the case, and, one which is structurally stronger than its accordian pleated counterpart.

As related to a suitcase, which does not necessarily incorporate a lid but instead incorporates flexible top and bottom walls, the main frame of the case in an alternative embodiment is provided with opposed top and bottom walls of opposed end walls, or both, which can telescope one within the other in order that the periphery of the case can be expanded or contracted as desired, a plurality of top and bottom walls of different area being provided that can be attached to the main body of the suitcase by slide fasteners, the rigid walls of the main body of the case being provided with any convenient securing means for holding the telescoping sections in their desired position of adjustment.

Thus, in this alternative embodiment of the invention the volume of the case can be increased or decreased at will by the user by the mere act of sliding the telescoping sections relative to each other to a desired volume of suitcase, and then attaching appropriate top and bottom panels to the thusly adjusted frame.

The invention also has application in cases for the carrying of files, of in carrying cases known as pilots cases. In a further alternative embodiment, such a carrying case includes a bottom tray-like structure that is telescopingly received within an upper case structure and which can be secured to the upper case structure in any one of a number of selected positions, thus permitting the volume of the carrying case to be adjusted to meet specific requirements.

DESCRIPTION OF THE DRAWINGS

The invention will now be described with reference to the accompanying drawings which illustrate preferred embodiments of the invention, and in which.

DESCRIPTION OF THE DRAWINGS

Figure 1:
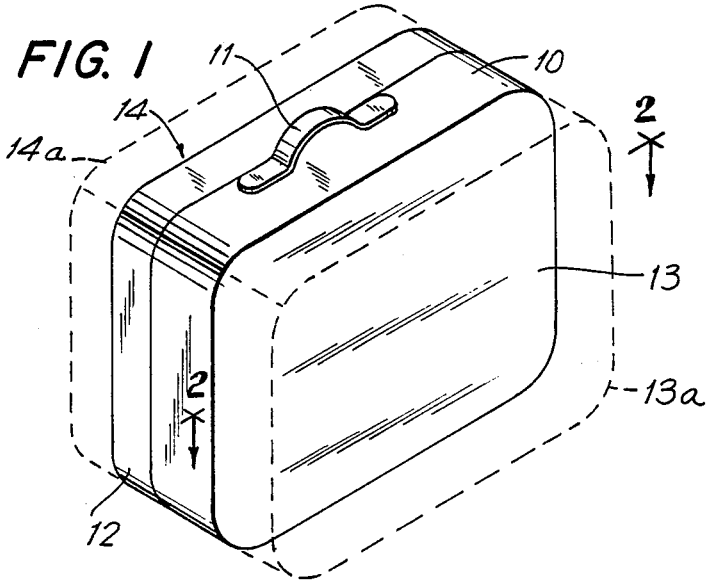
FIG. 1 is a perspective view of a brief case or suitcase embodying the present invention.
Figure 2:
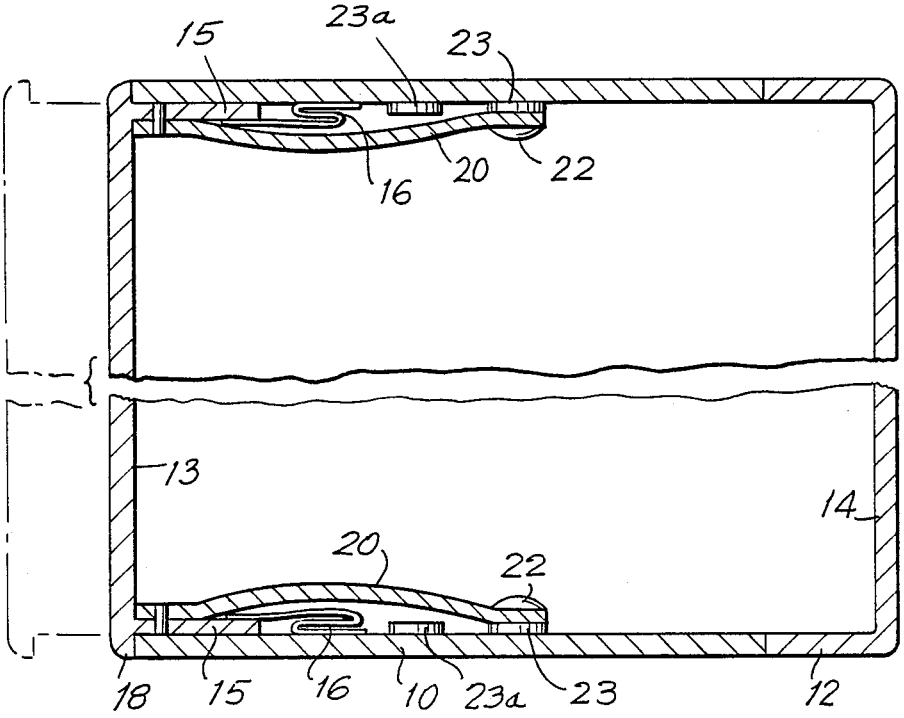
FIG. 2 is a cross section through the case of FIG. 1 taken on the line 2—2 of FIG. 1.

Referring first to FIGS. 1 and 2, a carrying case is shown, which typically is a brief case or a suitcase.

As more clearly shown in FIG. 1, the carrying case incorporates a main body 10 which includes a rigid peripheral frame, the main body conveniently being provided with a carrying handle 11, and being closed at one of its sides by a lid 12 incorporating a top wall of the case.

The bottom of the case is closed by a bottom panel 13, and, a top panel 14 provides a closure for the lid.

As is indicated by chain dotted lines in FIG. 1, the purpose of the present invention is to permit the interior volume of the case to be expanded or reduced by moving the bottom panel 13 between its position shown in full lines and the position indicated in chain dotted lines 13*a*. Similarly, and if desired, provision is made for moving the top panel 14 between the position indicated and the position indicated by the chain dotted lines 14*a* for the purpose of further expanding or reducing the internal volume of the case.

The manner in which this movement of the bottom panel 13 is permitted is more clearly illustrated in the cross-sectional illustration of FIG. 2.

Referring now to FIG. 2, the bottom panel 13 is secured at its periphery to a rigid frame 15 that is telescopingly received within the rigid frame of the main body 10. Thus, the bottom panel 13 is moveable away from or towards the main body 10 between the position indicated and an extended indicated by a chain dotted lines 13*a*. In that later position, the rigid frame 15 remains partially telescope within the rigid frame of the main body, the main body thus providing for the stability of the bottom panel 13 and its rigid frame 15.

Conveniently, a waterproof bellows 16 is provided internally of the main body 10 interconnecting the frame of the main body 10 and the rigid frame 15 of the bottom panel 13, the waterproof bellows additionally acting to limit the extent to which the rigid frame 15 of the end panel 13 can be moved outwardly from the rigid frame of the main body 10.

In order to prevent collapsing of the bottom panel 13 into the main body 10 of the case, either the rigid frame 15 is provided with an outwardly extending peripheral lip 18, or, the functional equivalent of that peripheral lip 18 is provided by the bottom panel 13 itself in the event that the bottom panel 13 is a panel of a rigid material.

Any convenient means can be provided for securing the bottom panel 13 and its rigid peripheral frame 15 in the retracted position relative to the main body 10. As illustrated, this is provided by straps 20 of a flexible material which are directly attached to the bottom panel 13 or the rigid peripheral frame 15 of the bottom panel at one end of the straps, the opposite end of the straps being provided with a press fastener 22 for cooperation with a corresponding press stud fast with the main body 10. Several such cooperating press studs can be provided in in-line series, thus permitting the adjustment of the bottom panel 13 and its rigid peripheral frame 15 to any one of a number of positions of adjustment. Any other convenient form of securing means can be employed, such as toothed rack attached to one or other of the frame members, and which is slidable within a channel attached to the other of those members, a detent being provided for locking the toothed rack in a selected position of adjustment relative to the associated channel member.

While the invention has so far been described with reference to the bottom wall 13 of the case, it will be appreciated that the lid 12 can be of similar or identical construction, thus permitting the lid 14 to be expanded or retracted in the manner described with respect to the bottom wall 13.

The construction so far described is of particular utility in a carrying case in which the opposed top and bottom panels are formed from a rigid material. Such, however, is not necessarily present in a suitcase construction in which the respective top and bottom panels are formed from a flexible fabric material. In this event, sections of the main body of the suitcase can be telescopingly arranged, such that the main body can be expanded or contracted to the size of any of one of a plurality of top and bottom panels of different area, and which are attachable to the main frame by conventional slide fasteners.

Figure 3:
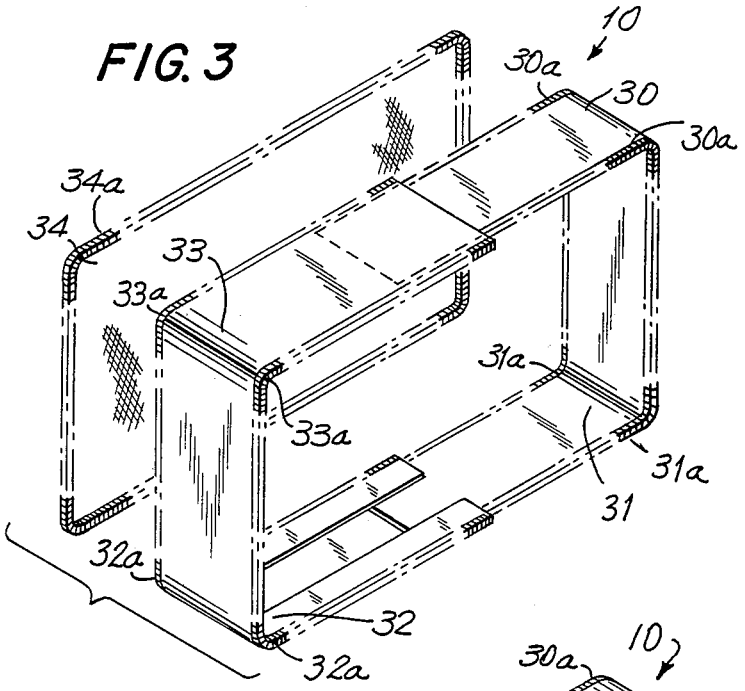
FIG. 3 is a diagramatic perspective view of an alternative embodiment of the invention in the form of a suitcase.
Figure 4:
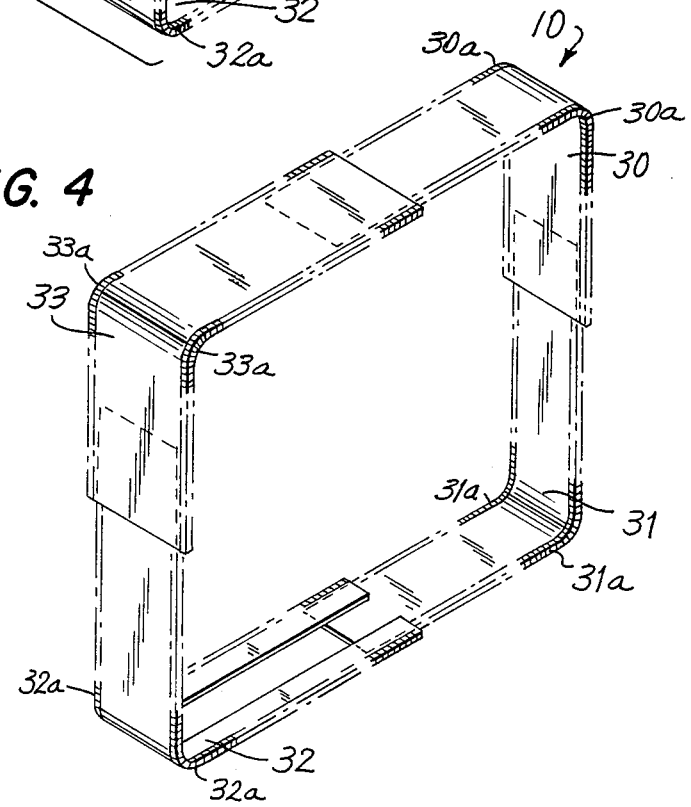
FIG. 4 is a diagramatic perspective view of the frame of FIG. 3 when in another position of adjustment.

This concept is diagramatically illustrated in FIGS. 3 and 4, in which the main body of the case, indicated generally at 10 is made up of four main frame members 30, 31, 32 and 33 which telescope one within the other at their respective ends, the respective main frame members 30–33 each being of generally of L-shape configuration. Alternatively, the members 30 and 31 and the members 32 and 33 can be combined into a U-shaped member, in order to provide for lateral enlargement or reduction of the volume of the case, or, the main frame members 30, 33 and 31, 32 can be combined into a U-shaped member this providing for expansion or reduction of the volume of the case in a vertical direction only.

Each of the main frame members 30–33 is provided with one element of a slide fastener extending along its opposite lateral edges, and of which is for cooperation with a mating slide fastener element of a selected size of end panel 34 to be attached to the opposite lateral edges of the main body 10, as indicated diagramatically in FIG. 3, the slide fastener elements of the respective main body and end panels being indicated by the number of that member accompanied by the suffix a.

Figure 5:
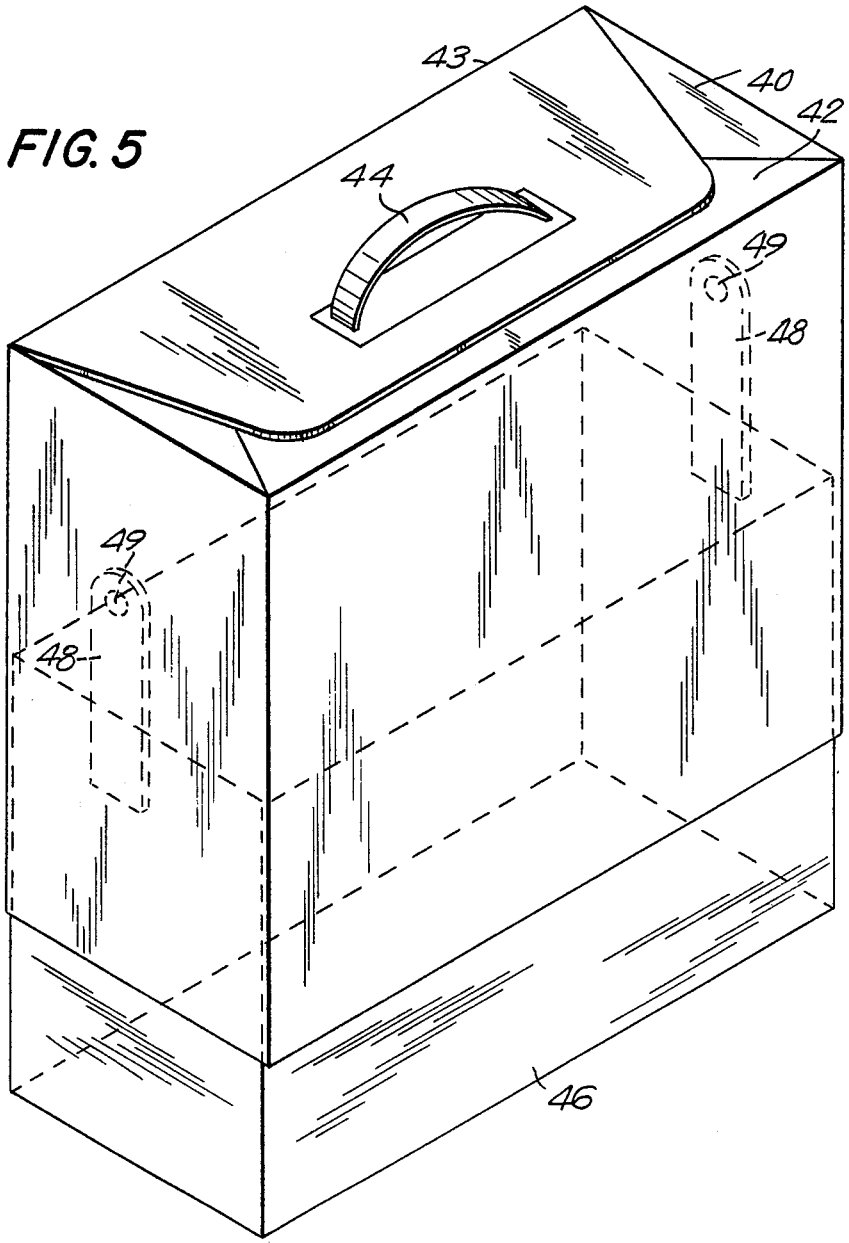
FIG. 5 is a diagramatic perspective view of a file case embodying the present invention.

Referring now to FIG. 5, an alternative form of carrying case for files and the like is shown, the carrying case including a main upper portion 40 of box-like formation, and which is provided with closure flaps 42 and 43 and a carrying handle 44.

The box-like top portion 40 has no bottom wall, but instead receives a tray-like portion 46 in telescoping relation therewith. In a manner similar to that previously described with reference to FIG. 2, straps 48 or other securing members are provided for limiting movement of the lower tray structure 46 out of the top box-like structure 40, the straps being attachable to the top box structure 40 by press fasteners 49.

By this structure, in common with the structures disclosed with respect to FIGS. 1–4, the case can be adjusted in internal volume by adjustment of the extent of telescoping of the lower tray member 46 within the upper box-like member 40. As previously described, preferably a bellows interconnection is provided between the upper edge of the lower tray section 46 and the top box-like member 40 to limit the extent to which the lower tray-like section is moveable out of the upper box-like section 40. Also, as previously described, a plurality of press studs can be provided in an in-line series on the inner surface of the upper box-like member 40, and, which are selectively engageable by a snap fastener carried by the respective straps 48.

It will be appreciated that various modifications of the preferred embodiments described above can be made without departing from the scope of the appended claims defining the scope of the invention.

I claim:

1. A carrying case, comprising:

a substantially rigid first case portion providing a peripheral wall of said case;

a second case portion having a substantially rigid peripheral wall telescopingly received within said peripheral wall of said first case portion, said second case portion also having a side wall of said carrying case co-extensive with said rigid wall portion of said second case portion;

means for securing said second case portion within said first case portion in any one of plural determined positions in which a free edge of said substantially rigid peripheral wall of said second case portion is positioned within and concealed by said substantially rigid first case portion; and, a waterproof bellows having opposite ends, said waterproof bellows being positioned within said case portion, the respective ends of said waterproof bellows being connected respectively to an interior wall surface of said first case portion and an interior wall surface of said second case portion;

said waterproof bellows having an axial extent, when extended, which will prevent said second case portion from being withdrawn completely from said first case portion;

whereby, said waterproof bellows is operative to prevent accidental dislodgement of said second case portion from said first case portion, said waterproof bellows being contained entirely within said carrying case and hidden from view externally of said case.

* * * * *